United States Patent [19]

Keller et al.

[11] 4,241,768

[45] Dec. 30, 1980

[54] INFANT BOTTLE AIR REMOVAL MEANS

[76] Inventors: Charles Keller, 4625 Ella St., Philadelphia, Pa. 19120; Paul Maria, 1402 Schwenkmill Rd., Perkasie, Pa. 18944

[21] Appl. No.: 58,576

[22] Filed: Jul. 18, 1979

[51] Int. Cl.[3] ..... B67C 9/00

[52] U.S. Cl. ..... 141/8; 141/313; 150/0.5; 215/11 E

[58] Field of Search ..... 215/11 E, 11 C; 141/4–8, 311 R, 313; 150/0.5

[56] References Cited

U.S. PATENT DOCUMENTS

| | | | |
|---|---|---|---|
| 2,701,672 | 2/1955 | Glasco | 141/313 |
| 2,773,521 | 12/1956 | Persson | 141/5 |
| 3,310,190 | 3/1967 | Hurst | 214/11 C |
| 3,358,864 | 12/1967 | Meierhoefer . | |
| 3,648,873 | 3/1972 | Grobbel . | |
| 3,651,973 | 3/1972 | Yamauchi . | |

*Primary Examiner*—Donald F. Norton

*Attorney, Agent, or Firm*—Seidel, Gonda, Goldhammer & Panitch

[57] ABSTRACT

A hollow vessel of resilient material and which is easily collapsible by hand is utilized to remove air from within an infant bottle by way of the nipple. Removal of such air causes the liquid in the infant bottle to rise while the liner of the infant bottle collapses.

5 Claims, 3 Drawing Figures

INFANT BOTTLE AIR REMOVAL MEANS

BACKGROUND

A large number of nipples for use on an infant bottle have been proposed heretofore. For relevant prior art, see U.S. Pat. Nos. 3,651,973; 3,648,873 and 3,358,864. The devices disclosed in said patents require special considerations, special construction for venting air, or a special device for collapsing the liner containing the liquid by contact with the liner. The present invention solves the problem of removing air from within the collapsible liner in a manner which is simple, inexpensive and reliable.

SUMMARY OF THE INVENTION

The infant bottle air removal means of the present invention is comprised of a hollow ball or cylindrical type vessel of a size so as to be easily collapsible by hand. The vessel is made from a resilient material capable of resuming its predetermined shape when collapsed and then released. The vessel has only one opening which is reinforced with a bead. The opening is of sufficient size to receive therein a nipple on an infant bottle while the bead engages a mounting portion of the nipple. Expansion of the vessel from a collapsed position sucks air from within the infant bottle by way of the slit in the nipple.

As the vessel expands and the air is removed, the upward movement of the liquid in the collapsible liner is visible. When the level of the liquid reaches the nipple, this is readily observable whereby the vessel may be removed.

It is an object of the present invention to provide a novel air removal means for an infant bottle of the type having a collapsible liner containing liquid in a manner whereby the liner is not contacted to cause the same to collapse.

It is another object of the present invention to provide an infant bottle air removal means which is simple, inexpensive, easy to use, reliable and rapid.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
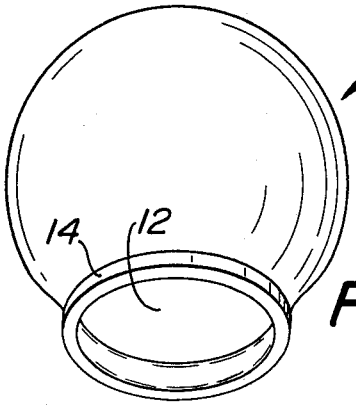
FIG. 1 is a perspective view of a hollow vessel in accordance with the present invention.

Referring to the drawings in detail, wherein like numerals indicate like elements, there is shown in FIG. 1 a hollow vessel designated generally as 10. Vessel 10 is of a size so as to be easily collapsible by hand. The vessel may be a generally spherical shape as illustrated in FIG. 1 or may be cylindrical. A typical diameter of the vessel 10 is between 2 and 4 inches.

The vessel 10 is preferably made from a resilient transparent material such as rubber or some other polymeric plastic material whereby the vessel will resume the shape as shown in FIG. 1 when collapsed and then released. Vessel 10 has only one opening designated 12. Opening 12 is provided with a reinforced bead 14. The opening 12 is preferably circular with a diameter of about $\frac{5}{8}$ inch to $\frac{3}{4}$ inch so that it may readily receive therein a nipple on an infant bottle.

Figure 2:
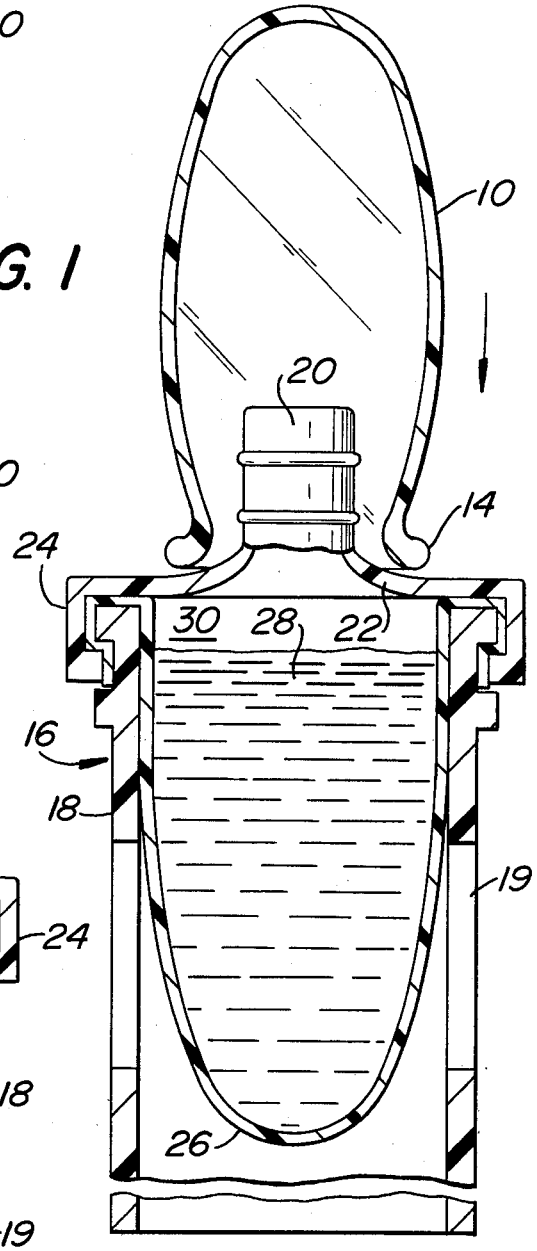
FIG. 2 is a sectional view through an infant bottle with the nipple extending into a partially collapsed hollow vessel of the present invention.

Referring to FIG. 2, there is shown an infant bottle designated generally as 16. The infant bottle 16 includes a sleeve 18 which may be open at its ends as illustrated or if desired, the bottom end may be closed. Sleeve 18 may be made transparent, translucent or opaque. A nipple 20 extends from a nipple support portion 22 which in turn is removably attached to one end of the sleeve 18 by way of a flange 24. The flange 24 overlies the upper end of a collapsible liner 26. The position of the liner 26 is readily observable through the slots 19 in the sleeve 18. The collapsible liner 26 contains a liquid such as milk or juice and designated 28. The space above the liquid 28 constitutes an air pocket designated 30.

Figure 3:
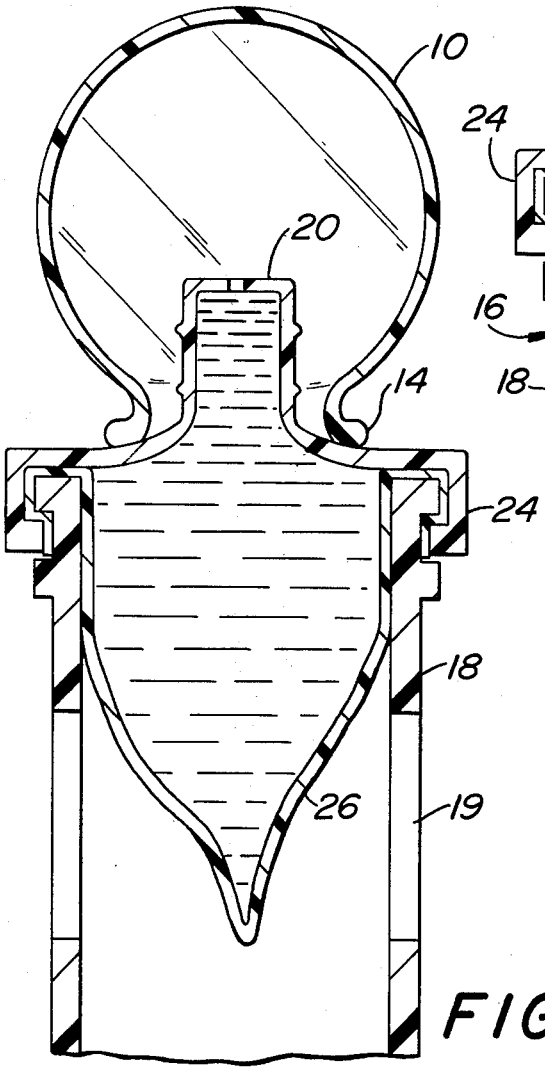
FIG. 3 is a view similar to FIG. 2 but showing the vessel in its normal expanded condition.

It is undesirable to feed an infant when there is an air pocket 30. To remove the air pocket 30, the vessel 10 is collapsed and positioned as shown in FIG. 2. Then the bead 14 is moved into contact with the portion 22. Thereafter, the vessel 10 is permitted to expand to the position shown in FIG. 3. As vessel 10 expands, the air in pocket 30 is removed by way of the slit in the nipple 20. Thereafter, the vessel 10 is removed. Removal of the air from pocket 30 takes 2 or 3 seconds and does not require any modifications to the infant bottle or the nipple. Vessel 10 is preferably made from a material which is capable of being sterilized.

Thus, it will be noted that the vessel 10 facilitates rapid removal of air from the pocket 30 and that the vessel is simple and inexpensive. The vessel 10 is reliable in performing this function since it is possible to observe the liquid 28 rising upwardly from the position shown in FIG. 2 to the position shown in FIG. 3 at which time the vessel 10 is then removed. No skill is required to use the present invention. Removal of the air from pocket 30 does not in any way require contact with the liner 20 which collapsed as the air was removed from the pocket 30. Since contact with the liner 26 to remove air is not necessary, the chances of puncturing the liner 26 are eliminated.

The present invention is not limited to use with the infant bottle as shown in the drawings but rather may be used with any one of a wide variety of infant bottles. The diameter of the hole 12 is preferably $\frac{5}{8}$ to $\frac{3}{4}$ inch so as to easily receive the nipple 20 therein while assuring that the diameter of the bead (about 1 inch) will be small enough so as to rest on and in sealing contact with the mounting portion 22 of the nipple radially inwardly of the flange 24.

The present invention may be embodied in other specific forms without departing from the spirit or essential attributes thereof and, accordingly, reference should be made to the appended claims, rather than to the foregoing specification, as indicating the scope of the invention.

We claim:

1. An infant bottle air removal means comprising a hollow vessel of a size so as to be easily collapsible by hand, said vessel being made from a resilient material which resumes its shape when collapsed and then released, said vessel having only one opening which is reinforced with a bead, said opening being of sufficient size so as to receive therein a nipple on an infant bottle while said bead engages a mounting portion of the nipple, whereby expansion of the vessel from a collapsed position can suck air out of an infant bottle by way of a slit in the nipple.

2. A device in accordance with claim 1 wherein the bead is thicker than the wall of the vessel.

3. A device in accordance with claim 1 wherein the vessel has a transverse dimension of about 2 to 4 inches while the opening has a transverse dimension of about $\frac{5}{8}$ to $\frac{3}{4}$ inch, and said bead having a transverse dimension not more than about 1 inch.

4. A device in accordance with claim 1 wherein said vessel is generally spherical and made from a material which is translucent or transparent.

5. A method of removing air from an air pocket above a liquid in a collapsible liner in an infant bottle comprising the steps of collapsing a hollow vessel of resilient material, inserting the nipple into a hole in said vessel, holding the periphery of the hole in sealing contact with a nipple support portion, then allowing the vessel to expand, using the expansion of said vessel to suck air out of said pocket by way of a slit in the nipple, whereby air from said pocket is removed without contacting the liner, then removing said nipple from said vessel.

* * * * *